US009546650B2

(12) United States Patent
Lundberg et al.

(10) Patent No.: US 9,546,650 B2
(45) Date of Patent: Jan. 17, 2017

(54) WATER-CONDUCTING HOUSEHOLD APPLIANCE

(75) Inventors: Mats Lundberg, Vaellingby (SE); Luigi Salerno, Cinisello Balsamo (IT); Oliver Kleinert, Lidingö (SE); Katherina Tzavella, Lidingö (SE)

(73) Assignee: Electrolux Home Products Corporation N.V., Brussels (BE)

( * ) Notice: Subject to any disclaimer, the term of this patent is extended or adjusted under 35 U.S.C. 154(b) by 619 days.

(21) Appl. No.: 13/996,665

(22) PCT Filed: Dec. 20, 2011

(86) PCT No.: PCT/EP2011/073369

§ 371 (c)(1),
(2), (4) Date: Sep. 9, 2013

(87) PCT Pub. No.: WO2012/084921

PCT Pub. Date: Jun. 28, 2012

(65) Prior Publication Data

US 2014/0134010 A1 May 15, 2014

(30) Foreign Application Priority Data

Dec. 21, 2010 (EP) ..... 10015868

(51) Int. Cl.

| | |
|---|---|
| ***F04B 39/00*** | (2006.01) |
| ***F04D 29/60*** | (2006.01) |
| ***A47L 15/42*** | (2006.01) |

(52) U.S. Cl.

CPC ..... *F04B 39/0044* (2013.01); *A47L 15/4214* (2013.01); *F04D 29/605* (2013.01)

(58) Field of Classification Search

CPC .... F04D 29/426; F04D 29/606; F04D 29/669; F04D 29/60; F16L 3/08; F16L 3/12; F16L 3/1222; F16L 41/086; F16L 41/12; F04B 39/0044; F04B 39/12; F04B 39/14; F16M 2200/024; F05B 2260/303; A47L 15/0052; A47L 15/4217; A47L 15/4214; A47L 15/4219; A47L 15/4225

(Continued)

(56) References Cited

U.S. PATENT DOCUMENTS 2,476,630 A * 7/1949 Schindler ..... E03C 1/2665 241/260
2,915,978 A * 12/1959 Schaefer ..... F04D 13/06 417/363

(Continued)

FOREIGN PATENT DOCUMENTS

DE 2157590 A1 5/1973
DE 2700637 A1 * 7/1978 ..... F04B 17/00
WO WO 00/54392 A1 9/2000

OTHER PUBLICATIONS

International Preliminary Report on Patentability and Written Opinion for Application No. PCT/EP2011/073369 dated Jun. 25, 2013.

(Continued)

*Primary Examiner* — Devon Kramer
*Assistant Examiner* — Kenneth J Hansen
(74) *Attorney, Agent, or Firm* — Alston & Bird LLP

(57) ABSTRACT

An example water-conducting household appliance, in particular dishwasher, comprising a motor-pump and a vibration-damping one-piece mounting for fixing the motor-pump to the appliance, the mounting having a through-hole for receiving the motor-pump is provided herein. The motor-pump has a housing comprising a mounting-section with a cylindrically shaped outer surface, and the through-hole has a circular cross-section adapted for receiving the cylindrically shaped outer surface of the motor-pump. The housing has at least two protrusions extending in an outward direction beyond the cross-section of the through-hole for con- (Continued)

Figure 1:
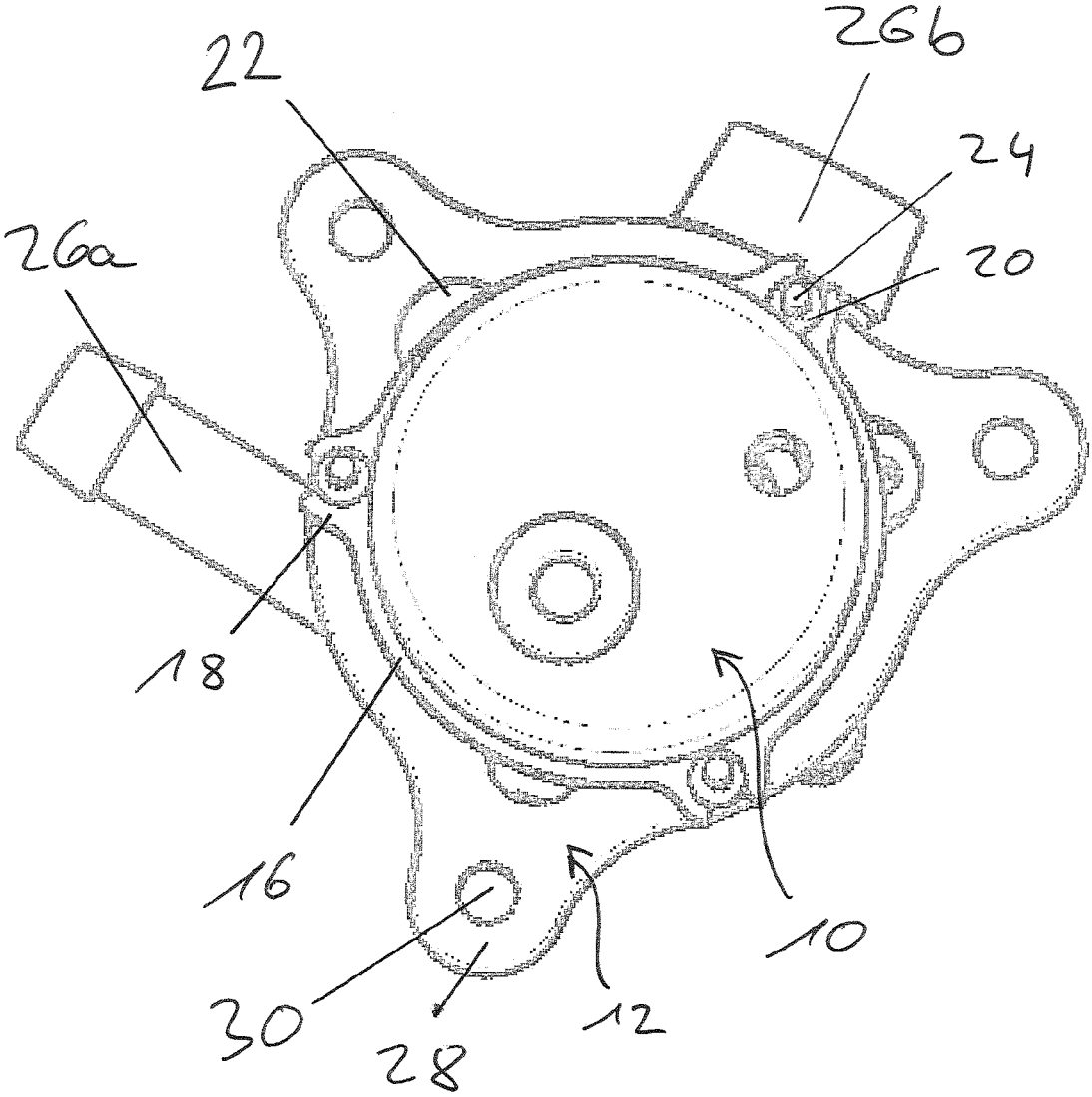

necting the housing to the mounting, and the mounting has cut-outs extending from the circular cross-section of the through-hole in an outward direction, the cut-outs and the protrusions of the housing being shaped so that for fixing the motor-pump to the mounting, the motor-pump can be partially fed through the through-hole by feeding each protrusion through a corresponding cut-out of the mounting.

13 Claims, 3 Drawing Sheets

(58) Field of Classification Search
USPC ..... 267/140.13, 141, 141.1, 141.11, 267/141.2–141.5; 417/360, 363; 415/213.1; 241/46.015
See application file for complete search history.

(56) References Cited

U.S. PATENT DOCUMENTS

| | | | | |
|---|---|---|---|---|
| 3,026,815 | A | 3/1962 | Jacobs | |
| 3,446,155 | A | 5/1969 | Guth | |
| 3,734,416 | A * | 5/1973 | Guth | E03C 1/2665 241/46.15 |
| 3,827,730 | A * | 8/1974 | Guth | E03C 1/266 241/46.015 |
| 4,221,547 | A | 9/1980 | Hoffman et al. | |
| 5,118,254 | A | 6/1992 | Ellingson et al. | |

OTHER PUBLICATIONS

International Searching Authority, International Search Report for International Application No. PCT/EP2011/073369, mailed Jul. 11, 2012, 5 pages, European Patent Office, The Netherlands.

* cited by examiner

WATER-CONDUCTING HOUSEHOLD APPLIANCE

CROSS REFERENCE TO RELATED APPLICATIONS

This application is a national stage application, filed under 35 U.S.C. §371, of International Application No. PCT/EP2011/073369, filed Dec. 20, 2011, which claims priority to European Patent Application No. 1001 5868.2, filed Dec. 21, 2010, both of which are hereby incorporated by reference in their entirety.

The present invention is related to a water-conducting household appliance according to the preamble of claim 1.

A water-conducting household appliance of the respective category, in particular a dishwasher, comprises at least one motor-pump for circulating and/or draining water for washing or cleaning purposes. Typically such motor-pumps are rather big and heavy and hence require a robust and reliable support or mounting. In order to reduce vibrations and noise spreading, the support should further be capable of damping these effects. In addition, due to the mass of the motor-pumps and because of space constraints, it could happen that the motor-pump touches the main structure of the household appliance with additional negative consequences from noise performance perspectives in case no adequate support is provided.

The German patent application DE 21 57 590 discloses a motor-pump for a washing machine or a dishwasher where a vibration damping support is provided for the motor-pump comprising an elastic mounting ring for receiving and fixing the motor of the pump.

The problem to be solved by the present invention is to provide a support or mounting for a motor-pump combining a good damping performance with an easy mountable and reliable fixation of the motor pump to the household appliance at any intended fixed orientation of the motor-pump within the household appliance. Especially a space-saving vertical orientation of the motor pump should be possible without the risk of the motor-pump moving out of the elastic mounting ring due its weight and due to vibrations.

This problem is solved by a household appliance according to the characterizing part of claim 1.

According to the invention the motor-pump has a housing comprising a mounting-section with a cylindrically shaped outer surface. A vibration-damping one-piece mounting for fixing the motor-pump to the appliance is provided, the mounting having a through-hole for receiving the motor-pump.

The respective through-hole has a circular cross-section adapted for receiving the cylindrically shaped outer surface of the motor pump. Hence, the through-hole of the mounting and the cross-section of the mounting-section of the motor-pump are shaped and dimensioned so that the motor pump can be introduced (at least partially along a length allowing a reliable fixing) into the mounting. Preferably the dimensions or diameters of through-hole and mounting-section are equal or approximately equal such that both part fit into another. The fit is preferable a slight press fit or a fit allowing a sliding of the motor within the through-hole. In both cases the motor-pump has to be movable by hand through the through-hole during assembly of the appliance. Alternatively some clearance can be provided between the two parts.

The housing of the motor-pump has at least two protrusions extending in an outward direction beyond the cross-section of the through-hole and comprising fixation means and/or openings for receiving fixation means for connecting the housing to the mounting. Since the protrusions extend beyond the cross-section of the through-hole, the overlapping region can serve as support for the pump and as an area, where the housing can be additionally connected to the mounting (in addition to the fit between the cylindrical surface and the edge of the through-hole).

The mounting further has cut-outs extending from the circular cross-section of the through-hole in an outward direction, where the cut-outs and the protrusions of the housing are dimensioned and shaped so that for fixing the motor-pump to the mounting, the motor-pump can be partially fed through the through-hole by feeding each protrusion completely through a corresponding cut-out of the mounting.

One of the advantages of the present invention is hence the fact that the cut-outs allow the usage of protrusions serving for a more reliable connection between pump and mounting. The housing can be fed through the through-hole of the mounting although the protrusions extend beyond the cross-section of the through-hole. After the motor-pump being fed into the through-hole of the mounting, the motor-pump can be turned so that the protrusions of the housing are no more in line with respective cut-outs and can be connected to an area of the mounting located between the cut-outs. After such a rotation of the motor-pump within the through-hole of the mounting, it can be fixed to the mounting by means of the fixation means and/or openings in the protrusions of the housing and corresponding means in the mounting.

In summary, a reliable connection between the motor-pump and the mounting is provided by fixing protrusions of the housing to the mounting. In addition, by means of the cut-outs, it is possible to move the section of the motor-pump comprising the protrusions through the mounting.

Preferred embodiments of the household appliance of the present invention are defined in the dependent claims.

Preferably the housing has a radial flange formed onto and extending in an outward direction from the cylindrical shaped mounting section. The flange has a radial outer diameter being larger than the diameter of the circular opening of the through-hole so that the motor-pump rests on the mounting by means of the flange. This is especially advantageous in embodiments where the pump is vertically mounted and the flange serves as an additional stop (together with the protrusions) against a downward movement of the pump. In this case, the protrusions of the housing are preferably formed onto the radial outer diameter of the flange. During assembly, each protrusion can again be fed through a corresponding cut-out of the mounting. However, the flange is fed through the through-hole by elastically deforming the mounting. The resulting advantage can best be seen with pumps being mounted in a vertical orientation: even a pump with larger connections e.g. at the lower end of the pump (which cannot be moved through the through-hole) can be mounted with the flange constituting a stop from above, i.e. from the other side against the mounting.

Preferably, the mounting is hence made of an elastic material like rubber or a rubber-like material and it can have the shape of a ring or of a flat circular band or of a hollow cylinder.

In a further preferred embodiment, the fixation means comprise an eyelet in each of the protrusions of the housing, the eyelet having a lateral opening for receiving a snap-fit element, preferably a pin with a stop or a mushroom-like extension formed onto the mounting for locking engagement with the eyelet for fixing the motor-pump to the mounting.

Especially in combination with a rubber-like material this leads to a very convenient and cost-saving snap-fit connection.

The motor-pump comprises a motor and a pump both of them having a rotatable shaft being in connection and in straight alignment with each other thereby defining a motor-pump axis. In a further preferred embodiment the motor-pump is mounted within the appliance with this axis being vertically oriented leading to space-saving solution.

In cases where the motor-pump comprises a water inlet and a water outlet at a first end of the motor-pump, the mounting is preferably positioned between this respective end and the flange so that the mounting is compassed by the end with the inlet and outlet (both of them usually projecting beyond the housing) and the flange. The motor-pump can hence be mounted within the appliance with the first end comprising the water inlet and the water outlet being the lower end of the motor-pump and the flange can be is fixed against the upper side of the mounting.

Preferably, also the mounting comprises at least two protrusions extending radially in an outward direction. These protrusions can comprise fixation means and/or openings for receiving fixation means for fixing the mounting to the appliance.

Preferably, the mounting has the symmetry of an equilateral triangle defined by three protrusions of the mounting and the protrusions of the mounting can extend in an outward direction being perpendicular to the motor-pump axis.

The protrusions and the cut-outs of the mounting are preferably aligned in pairs in radial outward directions where in a specific direction the cut-out is followed by the respective protrusion.

In a further preferred embodiment the protrusions of the housing are equally spaced around the housing with an angular distance and the cut-outs of the mounting are equally spaced around the through-hole with the same angular distance. Hence, the protrusions have the same distribution as the cut-outs.

Preferably, the mounting has fixation means for connection with the respective fixation means of the protrusions of the housing. The fixation means of the mounting are equally spaced around the through-hole of the mounting with a fixed angular distance and the protrusions of the housing are equally spaced around the housing with the same angular distance so that a connection of each fixation means with its respective protrusion is made possible. Preferably the fixation means of the mounting are positioned with an angular off-set with respect to the cut-outs of the mounting hence taking the rotation of the pump during mounting into account.

Figure 2:
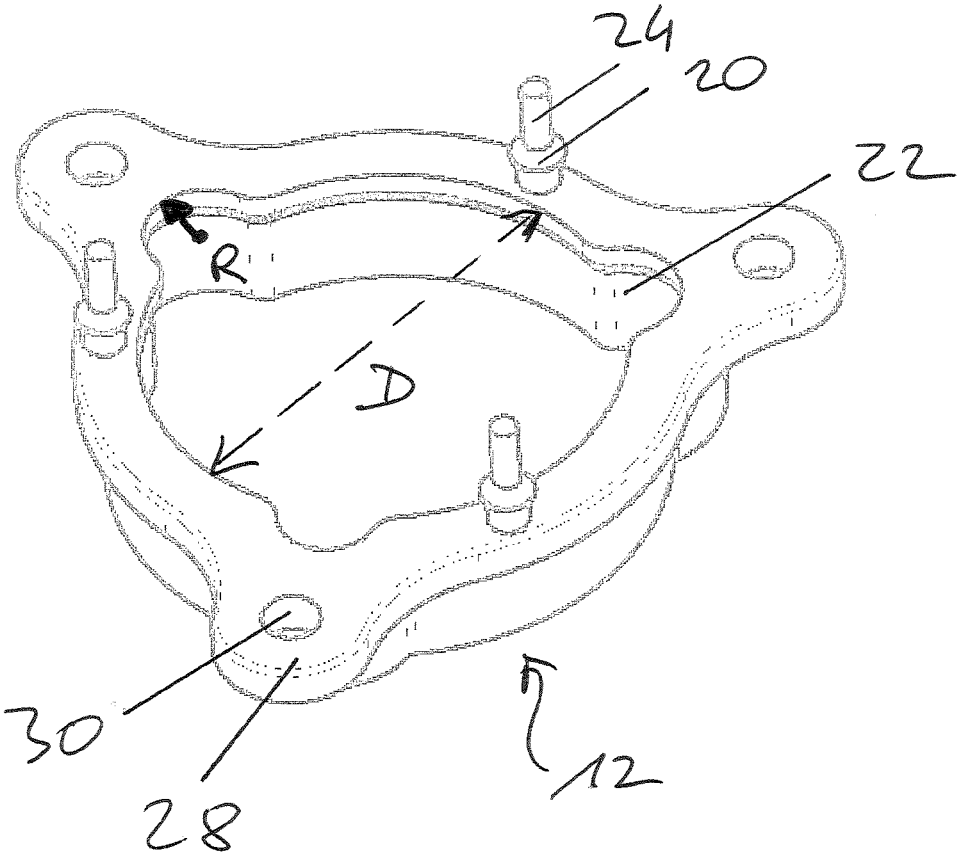
Figure 3:
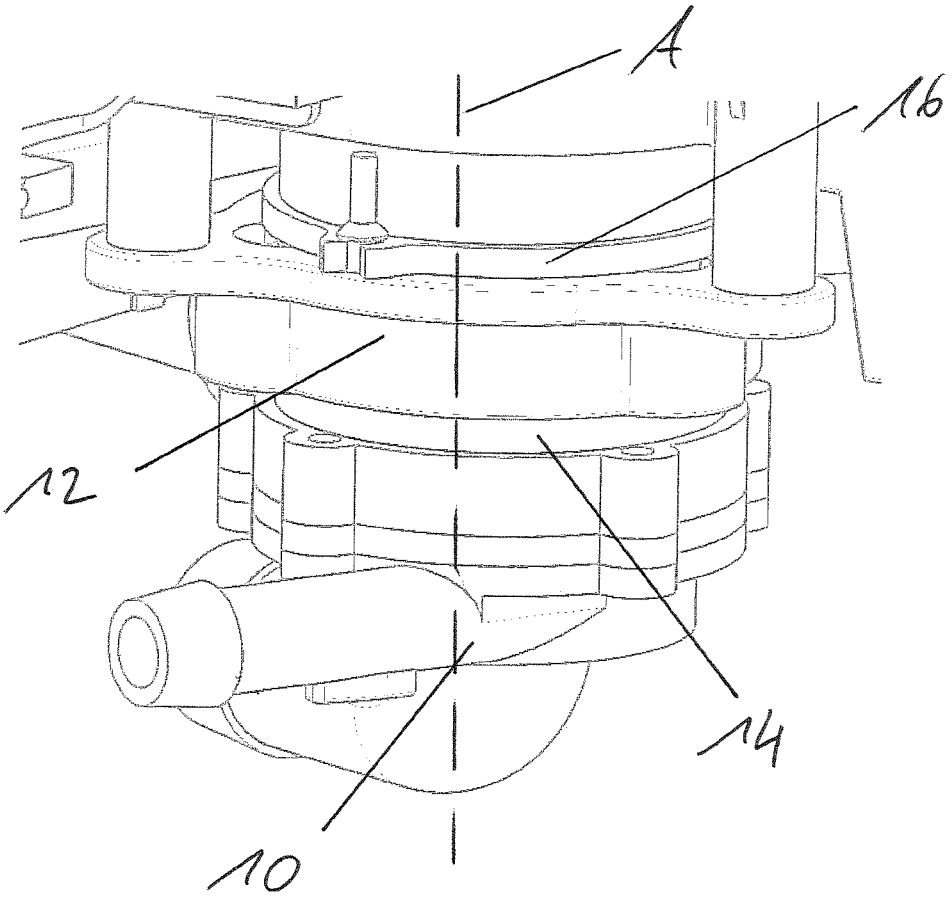

A preferred embodiment of the present invention it is described in further detail below by reference to the accompanying drawings, in which:

FIG. 1 is a view onto a mounting supporting a water-pump according to the present invention; and FIG. 2 is a perspective view onto a mounting according to FIG. 1; and FIG. 3 is a perspective view from the side onto the mounting and the motor-pump of FIG. 1.

FIGS. 1, 2 and 3 show a mounting 12 according to the present invention having a through-hole with a circular cross-section into which a motor-pump 10 is inserted. The housing of the motor-pump 12 has a mounting-section 14 with a cylindrically shaped outer surface fitting to a through-hole within the mounting 12 with a circular cross-section of the same or of a similar diameter. The two dimensions, i.e. the diameter of the circular cross-section of the mounting-section 14 and the diameter D (see FIG. 2) of the through-hole in the mounting 12 can be chosen so as to provide a slight press-fit (movable by hand) of the motor-pump 10 within the mounting 12 or the opening, i.e. the through-hole within the mounting 12 can be slightly larger than the diameter of the mounting-section 14. Such a difference can be in the range up to 10 mm.

For fixing the motor-pump 10 to the mounting 12 protrusions 18 are provided on the housing of the motor-pump 10 forming eyelets or through-holes having a lateral opening. By means of these eyelets, a pin 24 having a stop 20, the pin being formed onto the mounting 12, can be received by the eyelet such that a snap-fit connection between the motor-pump 10 and the mounting 12 can be achieved. Hence, corresponding fixation means 18 and 24 are formed onto the housing on the motor-pump 10 and onto the mounting 12 so that an easy-to-use and cost-saving connection between the motor-pump 10 and the mounting 12 is provided.

It can be seen from FIGS. 1 and 3 that further a flange 16 is provided in the area of the mounting section 14 of the motor-pump 10. This flange 16 has an outer diameter being larger than the opening or through-hole of the mounting 12. By means of the contact of this flange 16 with the mounting 12, the connection between the motor-pump 10 and the mounting 12 is further improved. Especially in the embodiment of FIG. 3, where the motor-pump 10 is mounted with its axis A being vertically oriented with respect to the household appliance, the flange 16 acts as a further stop being formed onto the housing of the motor-pump 10 so that the weight of the motor-pump 10 needs not to be held by the pins 24 and the corresponding protrusions 18 only.

As can be seen from FIG. 1 and FIG. 3, motor-pump 10 further has at its lower end a water inlet 26*a* and a water outlet 26*b*. Inlet 26*a* and outlet 26*b* need to have a minimum length so that e.g. a water-conducting hose can securely be connected to the motor-pump 10. In addition, the space above the motor-pump 10 is very limited. These two aspects make it impossible to insert the motor-pump 10 from above into the mounting 12. On the other hand the protrusions 18 of the motor pump 10 and also the flange 16 normally would make it impossible to stick the motor-pump 10 from below into the mounting 12. Since it would be very difficult and hence cost-spending to provide the motor-pump 10 in two parts and mounting both parts from different sides into the mounting 12, the following features are provided according to the present invention. Mounting 12 has cut-outs 22 extending from the circular cross-section of the through-hole in an outward direction. These cut-outs 22 are shaped and dimensioned such that they allow the protrusions 18 of the motor-pump 10 to be passed through it in order to feed the motor-pump 10 into the through-hole of mounting 12. As shown in the Figures, protrusions 18 and cut-outs 22 can be shaped so that both have a circular border line (Radius R) defining corresponding sections of a circle. For example, the protrusions 18 as well as the cut-outs 22 can be shaped to be half-circles. It follows also from FIGS. 1 and 3 that also the flange 16 has to be passed through the through-hole of the mounting 12 although it has a larger diameter than the opening of the through-hole. In order to solve this problem and also in order to provide for the necessary damping characteristics, mounting 12 is made of an elastic rubber material. It is hence possible to slightly deform mounting 12 elastically so as to transfer the flange 16 through the opening or through-hole of mounting 12 from the lower side of the household appliance.

As can be best seen in FIG. 1 it is necessary to provide the pins 24 within an area of the mounting 12 outside the region of the cut-outs 22. In case of this preferred embodiment protrusions 18 as well as cut-outs 22 and pins 24 are provided at positions defining an equilateral triangle. However, the triangle of the pins 24 is rotated with respect to the triangle defined by the cut-outs 22. It is thereby possible to pass the protrusions 18 of the motor-pump 10 through the cut-outs 22 and then turning the motor-pump 10 such that the protrusions 18 can be fixed to the pins 24.

Mounting 12 further comprises protrusions 28 having openings 30 (see FIGS. 1 and 2). By means of these protrusions 28 and openings 30 mounting 12 can be connected to a structure of the household appliance (as shown in FIG. 3). Since according to the invention the motor-pump 10 can easily be connected from below to the mounting 12, it is possible to first fix the mounting 12 e.g. by means of screws through the openings 30, the screws entering respective threaded holes in the structure of the household appliance. In the preferred embodiment of the Figures, also protrusions 28 define an equilateral triangle. This triangle has the same orientation as the triangle defined by cut-outs 22. Therefore, cut-outs 22 and protrusions 28 are aligned in a radial direction with respect to the center of the circular through-hole. This alignment of cut-outs 22 with protrusions 28 has the advantage of material saving since the material used for the protrusion 28 can be saved by means of the respective cut-out 22. In other words, having the cut-out 22 at a different position would make it necessary to form an additional respective elongation or protrusion onto the mounting 12 in order to provide for a minimum material thickness of the mounting in the area of the cut-out.

Since mounting 12 is not only responsible for a secure fixation of motor-pump 10 to the household appliance but also acts as a damper for vibrations, it is also an advantage that the mounting 12 according to the present invention can be tuned with respect to its damping properties. In addition, since the mounting 12 needs to be elastically deformed when introducing the motor-pump 10, it is also desired to adapt the respective rigidity of mounting 12. Since the damping properties and also the stiffness are not only influenced by material properties, but also by the shape of mounting 12, these parameters can be adjusted in an easy way by using according diameters and positions of the openings 30 and the cut-outs 22 as well as by adapting the shape of protrusions 28. In such a way stiffness and damping properties of the mounting 12 can be optimized.

LIST OF REFERENCE SIGNS

10 motor-pump
12 mounting
14 mounting section
16 flange
18 protrusion
20 stop
22 cut-out
24 pin
26*a, b* water inlet/outlet
28 protrusion
30 opening

The invention claimed is:

1. A pump assembly for a water-conducting household appliance comprising:

(a) a motor-pump, and (b) a vibration-damping mounting for fixing the motor-pump to the appliance, the mounting having a through-hole for receiving the motor-pump, wherein:

(c) the motor-pump has a housing comprising a mounting-section with a cylindrically shaped outer surface, (d) the through-hole has a cross-section adapted for receiving the cylindrically shaped outer surface of the motor-pump, (f) the housing has at least two protrusions extending in an outward direction beyond the cross-section of the through-hole and comprising fixation members for receiving corresponding fixation members on the mounting for connecting the housing to the mounting, wherein the housing has a radial flange formed onto and extending in an outward direction from the cylindrical shaped mounting section, wherein the motor-pump is configured to rest on the mounting by way of the flange, and (g) the through-hole has cut-outs extending directly from the periphery of the through-hole in an outward direction, the cut-outs and the protrusions of the housing being shaped so that the motor-pump can be fed through the through-hole by feeding each protrusion through a corresponding cut-out of the mounting such that a portion of the motor-pump and the protrusions are each positioned past the through-hole of the mounting for fixing the motor pump to the mounting.

2. A pump assembly according to claim 1, wherein the radial flange has a radial outer diameter being larger than a diameter of the opening of the through-hole so that the motor-pump rests on the mounting by way of the flange, wherein the at least two protrusions of the housing are formed onto the radial outer diameter of flange and where each protrusion can be fed through a corresponding cut-out of the mounting while the flange is fed through the through-hole by elastically deforming the mounting for fixing the motor-pump to the mounting.

3. A pump assembly according to claim 1, wherein the mounting is made of an elastic material.

4. A pump assembly according to claim 1, characterized in that the mounting has a shape of a ring or of a flat circular band or of a hollow cylinder.

5. A pump assembly according to claim 1, characterized in that the fixation members of the housing comprise an eyelet in each of the protrusions of the housing, the eyelet having a lateral opening for receiving a snap-fit element formed onto the mounting for locking engagement with the eyelet for fixing the motor-pump to the mounting.

6. A pump assembly according to claim 1, characterized in that the motor-pump comprises a motor and a pump both of them having a rotatable shaft being in connection and in straight alignment with each other thereby defining a motor-pump axis and in that the motor-pump is mounted within an appliance with the axis being vertically oriented.

7. A pump assembly according to claim 2, wherein the motor-pump comprises a water inlet and a water outlet at a first end of the motor-pump and the mounting is positioned between this respective end and the flange.

8. A pump assembly according to claim 7, wherein the motor-pump is mounted within the appliance with the first end comprising the water inlet and the water outlet and being the lower end of the motor-pump and the flange is fixed against the upper side of the mounting.

9. A pump assembly according to claim 1, wherein the mounting has the symmetry of an equilateral triangle defined by three protrusions of the mounting.

10. A pump assembly according to claim 1, wherein the protrusions of the mounting extend in an outward direction being perpendicular to the motor-pump axis (A).

11. A pump assembly according to claim 10, wherein the protrusions and the cut-outs of the mounting are aligned in pairs in radial outward directions where in a specific direction each cut-out is followed by a respective protrusion.

12. A pump assembly according to claim 1, wherein the protrusions of the housing are equally spaced around the housing with an angular distance and the cut-outs of the mounting are equally spaced around the through-hole with the same angular distance.

13. A pump assembly according to claim 1, wherein the fixation members of the mounting members are equally spaced around the through-hole of the mounting with an angular distance and the protrusions of the housing are equally spaced around the housing with the same angular distance, and wherein the fixation members of the mounting are positioned with an angular off-set with respect to the cut-outs of the mounting.

* * * * *